US005817191A

United States Patent [19]

Emmerich et al.

[11] Patent Number: 5,817,191

[45] Date of Patent: Oct. 6, 1998

[54] IRON-BASED SOFT MAGNETIC ALLOY CONTAINING COBALT FOR USE AS A SOLENOID CORE

[75] Inventors: Kurt Emmerich, Alzenau; Hartwin Weber; Hermann Wegerle, both of Hannau, all of Germany

[73] Assignee: Vacuumschmelze GmbH, Hanau, Germany

[21] Appl. No.: 920,285

[22] Filed: Aug. 26, 1997

Related U.S. Application Data

[63] Continuation-in-part of Ser. No. 556,428, Nov. 9, 1995, abandoned.

[30] Foreign Application Priority Data

Nov. 19, 1995 [DE] Germany ..... 44 42 420.5

[51] Int. Cl.[6] ..... H01F 1/147

[52] U.S. Cl. ..... 148/311; 420/104; 420/107; 420/111; 420/114; 420/122; 420/123; 420/124; 420/127

[58] Field of Search ..... 148/311; 420/104, 420/107, 111, 114, 122–124, 127

[56] References Cited

U.S. PATENT DOCUMENTS

| | | | |
|---|---|---|---|
| 3,502,462 | 3/1970 | Dabkowski et al. | 420/107 |
| 4,076,525 | 2/1978 | Little et al. | 420/107 |
| 4,891,079 | 1/1990 | Nakajima et al. | 420/104 |
| 5,087,415 | 2/1992 | Hemphill et al. | 420/107 |
| 5,252,940 | 10/1993 | Tanaka | 148/311 |
| 5,268,044 | 12/1993 | Hemphill et al. | 420/107 |

FOREIGN PATENT DOCUMENTS

| | | | |
|---|---|---|---|
| 45-35419 | 11/1970 | Japan | 148/311 |
| 55-107760 | 8/1980 | Japan | 420/104 |
| 64-65201 | 3/1989 | Japan | 420/104 |

OTHER PUBLICATIONS

"Detroit Diesel Electronic Control," Hames et al., Society of Automotive Engineers Publication No. 85042 (1985).

"Weichmagnetische Werkstoffe," Boll, 1990, p. 107.

"IEC Standard," International Electrotechnical Commission Publication 404–1, p. 47 (1979).

*Primary Examiner*—John Sheehan

*Attorney, Agent, or Firm*—Hill & Simpson

[57] ABSTRACT

An iron-based, cobalt-containing soft magnetic alloy suitable for use as a core in a magnetic switch or other exciting circuits has a cobalt content of 6 through 30 weight percent, at least one of the elements chromium, molybdenum, vanadium and tungsten in range of 3 through 8 weight percent, and a remainder iron, possibly including inconsequential contaminants. The alloy has a coercive field strength of lower than or equal to 3.2 A/cm, and a saturation flux density of greater than 1.9 Tesla.

4 Claims, No Drawings

IRON-BASED SOFT MAGNETIC ALLOY CONTAINING COBALT FOR USE AS A SOLENOID CORE

This is a continuation-in-part of application Ser. No. 08/556,428, filed Nov. 9, 1995, now abandoned.

BACKGROUND OF THE INVENTION

1. Field of the Invention

The present invention is directed an iron-based, cobalt-containing soft magnetic alloy suitable for use as a solenoid core in a magnetic switch or exciting circuit.

2. Description of the Prior Art

Iron-based, cobalt-containing soft magnetic alloys are known which have a coercive field strength $H_c \leqq 3.2$ A/cm and a saturation flux density greater than 1.9 T. Alloys of this type are known, for example, from the IEC Standard, International Electrotechnical Commission Publication 404-1, page 47 (1979). These known alloys have a cobalt content of 23% through 27% by weight, as well as containing small additives of vanadium or chromium in order to improve the ductility. Such alloys are primarily used for applications requiring high saturation flux densities, or applications wherein high temperatures occur.

In the field of automation, significant efforts have been directed at achieving increasingly faster switching times in magnetic circuits, as well as in the utilization of magnetic exciting circuits for increasingly higher frequencies. Such circuits have in common the use of a solenoid control for effecting the switching, in the form of a coil or other type of excitation element operating in conjunction with a solenoid core which is displaced in the presence of an excitation current in the excitation element. In order to achieve faster switching times, as well as for achieving switching at higher frequencies, eddy currents must be minimized so that a rapid magnetization and a rapid demagnetization of the overall magnetic circuit can be achieved.

The desire to minimize eddy currents in the context of a magnetically switched (solenoid-operated) valve is described in Society of Automotive Engineers Publication No. 85042 (1985), page 5, right column. In that publication, a solenoid core composed of laminations is employed in order to reduce the eddy currents and thereby to achieve a fast switching response.

It is also known from the text Weichmagnetische Werkstoffe by R. Boll, 1990, page 107, that a limit frequency exists up to which the influence of eddy currents does not predominate in soft magnetic material. It is also known, as described in this text, that this limit frequency is proportional to the electrical resistivity of the soft magnetic material, and is inversely proportional to the thickness of the laminations employed in the magnetic circuit.

SUMMARY OF THE INVENTION

It is an object of the present invention to provide a core suitable for use in an excitation circuit in which an excitation element produces a magnetic field for acting on the core which has a high saturation flux density and low coercive field strength, and which also has a higher electrical resistivity than known cores.

The above object is achieved in accordance with the principles of the present invention in a core used in an excitation circuit containing cobalt in a range of 6 through 30 weight percent, and one or more of elements selected from the group of chromium, molybdenum, vanadium, and tungsten in a range of 3 through 8 weight percent, with the remainder iron and inconsequential amounts of contaminants as may arise in the course of manufacture.

DESCRIPTION OF THE PREFERRED EMBODIMENTS

Various cores for use in excitation circuits, such as magnetic switches, wherein a magnetic field is generated by the excitation of an excitation element, such as a coil, the magnetic field interacting with the core to cause displacement thereof, were manufactured in accordance with the principles of the present invention having the properties identified in the table below. All of these alloys have in common a cobalt content in a range of 6 through 30 weight percent, a content in the range of 3 through 8 weight percent of one or more of the elements chromium, molybdenum, vanadium and tungsten, and the remainder of the alloy being iron, possibly including inconsequential contaminants arising during the manufacturing procedure. All of these alloys have a coercive field strength lower than or equal to 3.2 A/cm, and a saturation flux density greater than 1.9 T.

Certain of the soft magnetic alloys in the table below can be further specified as having a cobalt content in a range from 10 through 20 weight percent.

Certain of the soft magnetic alloys in the table below can alternatively be characterized as having one or more of the elements chromium, molybdenum, vanadium and tungsten in a range between 4 and 8 weight percent. More specifically, certain of the soft magnetic alloys in the table below contain one or more of the elements chromium, molybdenum, vanadium and tungsten in a range from 5 to 8 weight percent, and those alloys have an electrical resistivity of greater than 0.5 $\mu\Omega\cdot$m and an induction of greater than 1.9 T, given a field strength of 160 A/cm.

TABLE

| Co % | V % | Mo % | Cr % | B (T) @ 160 A/cm | Hc (A/cm) | p ($\mu\Omega$m) |
|---|---|---|---|---|---|---|
| 10 | 3 | 3 | 0 | 2.03 | 1.74 | 0.511 |
| 15 | 0 | 2.5 | 3.5 | 2.01 | 2.57 | 0.531 |
| 15 | 0 | 1 | 4 | 2.02 | 2.82 | 0.532 |
| 15 | 0 | 3 | 3 | 2.02 | 2.60 | 0.499 |
| 15 | 0 | 2 | 2.5 | 2.06 | 2.92 | 0.469 |
| 15 | 0 | 2 | 4.5 | 1.98 | 2.43 | 0.587 |
| 15 | 3 | 3 | 0 | 2.02 | 1.74 | 0.531 |
| 15 | 2 | 2.5 | 0 | 2.07 | 2.45 | 0.450 |
| 15 | 3.5 | 1.5 | 0 | 2.03 | 2.14 | 0.503 |
| 15 | 4.5 | 2 | 0 | 1.98 | 1.39 | 0.600 |
| 15 | 2 | 4.5 | 0 | 2.03 | 1.92 | 0.442 |
| 15 | 3.5 | 4.5 | 0 | 2.01 | 0.94 | 0.578 |
| 15 | 2 | 2.5 | 2 | 2.01 | 1.96 | 0.568 |
| 20 | 2 | 2 | 2 | 2.02 | 2.51 | 0.605 |
| 20 | 3 | 3 | 0 | 2.02 | 2.24 | 0.543 |
| 30 | 2 | 0 | 0 | 2.33 | 2.64 | 0.324 |
| 30 | 0 | 2 | 0 | 2.28 | 7.10 | 0.210 |
| 30 | 0 | 2 | 2 | 1.92 | 3.25 | 0.468 |
| 25 | 4 | 0 | 0 | 2.16 | 2.10 | 0.483 |
| 25 | 2 | 2 | 0 | 2.16 | 2.89 | 0.431 |
| 20 | 2 | 0 | 0 | 2.10 | 1.83 | 0.291 |
| 20 | 0 | 2 | 0 | 2.17 | 2.56 | 0.298 |
| 20 | 2 | 0 | 2 | 2.06 | 1.04 | 0.511 |
| 15 | 4 | 0 | 0 | 2.06 | 1.09 | 0.397 |

In the above table, the symbol "%" means a weight percent of the designated element, B(T) means induction measured in Tesla given a field strength of 160 A/cm, $H_c$ indicates coercive field strength measured in amperes per centimeter, and ρ indicates electrical resistivity, measured in micro-ohm meters.

Detailed descriptions of the preparation and properties of a number of exemplary embodiments of a soft magnetic Co—Fe alloy in accordance with the invention are as follows:

EXAMPLE 1

An alloy with 17.0 weight % cobalt, 2.0 weight % chromium, 0.8 weight % molybdenum, 0.2 weight % vanadium and the remainder iron was melted in a vacuum. The cast block that arose was peeled to a diameter of 50 mm. Subsequently, the material was forged at (1100 . . . 850)°C. to a diameter of 18 mm. After an annealing in hydrogen for 10 hours at 865° C., a coercivity field strength of $H_c$=0.8 A/cm, an induction of $B_{160}$=2.10 T given a modulation of 160 A/cm, as well as a remanence $B_R$=0.98 T were measured. The specific electrical resistance amounted to 0.52 $\Omega mm^2/m$.

EXAMPLE 2

An alloy with 17.0 weight % cobalt, 2.0 weight % chromium, 0.8 weight % molybdenum, 0.2 weight % vanadium and the remainder iron was melted in a vacuum. The cast block that arose, deviating from Example 1, was forged to 20 mm×20 mm and subsequently warm-rolled at (1100 . . . 850) °C. to 3.5 mm. After an intermediate annealing for 0.5 hours at 900° C., it was cold-rolled to 1 mm. After an annealing in hydrogen for 10 hours at 865° C., a coercivity field strength of $H_c$=0.8 A/cm, an induction of $B_{160}$=2.10 T given a modulation of 160 A/cm, as well as a remanence $B_R$=0.98 T were measured. The specific electrical resistance amounted to 0.39 $\Omega mm^2/m$.

EXAMPLE 3

An alloy with 15.0 weight % cobalt, 2.0 weight % chromium, 2.5 weight % molybdenum, 2.0 weight % vanadium and the remainder iron was manufactured as in Example 1. After an annealing in hydrogen for 10 hours at 820° C., a coercivity field strength of $H_c$=1.98 A/cm, an induction of $B_{160}$=2.02 T given a modulation of 160 A/cm, as well as a remanence $B_R$=0.96 T were measured. The specific electrical resistance amounted to 0.53 $\Omega mm^2/m$.

EXAMPLE 4

An alloy with 15.0 weight % cobalt, 4.0 weight % chromium, 1.0 weight % molybdenum and the remainder iron was manufactured as in Example 1. After an annealing in hydrogen for 10 hours at 820° C., a coercivity field strength of $H_c$=1.27 A/cm, an induction of $B_{160}$=2.07 T given a modulation of 160 A/cm, as well as a remanence $B_R$=0.94 T were measured. The specific electrical resistance amounted to 0.51 $\Omega mm^2/m$.

EXAMPLE 5

An alloy with 20.0 weight % cobalt, 2.0 weight % chromium, 2.0 weight % molybdenum, 2.0 weight % vanadium and the remainder iron was manufactured as in Example 1. After an annealing in hydrogen for 10 hours at 865° C., a coercivity field strength of $H_c$=1.65 A/cm, an induction of $B_{160}$=2.09 T given a modulation of 160 A/cm, as well as a remanence $B_R$=0.86 T were measured. The specific electrical resistance amounted to 0.59 $\Omega mm^2/m$.

EXAMPLE 6

An alloy with 15.0 weight % cobalt, 2.0 weight % chromium, 2.5 weight % molybdenum, 2.0 weight % vanadium and the remainder iron was melted in a vacuum. The cast block that arose was peeled to a diameter of 50.0 mm. Subsequently the material was forged at (1,100 . . . 850) degrees Celsius to a diameter of 30 mm. After annealing in hydrogen for 10 hrs. at 840 degrees Celsius a coercivity field strength of $H_c$=1.96 A/cm, an induction of $B_{160}$=2.01 T given in the modulation of 160 A/cm, as well as a remanence $B_R$=0.97 T were measured. This specific electrical resistance amounted to 0.57 $\Omega mm^2/m$.

EXAMPLE 7

An alloy with 15.0 weight % cobalt, 4.0 weight % chromium, 1.0 weight % molybdenum and the remainder iron was melted in a vacuum. The cast block that arose was peeled to a diameter of 15.0 mm. After annealing in hydrogen for 10 hrs. at 820 degrees Celsius a coercivity field strength of $H_c$=2.82 A/cm, an induction of $B_{160}$=2.02 T given a modulation of 160 A/cm, as well as a remanence $B_R$=0.93 T were measured. The specific electrical resistance amounted to 0.53 $\Omega mm^2/m$.

EXAMPLE 8

An alloy with 20.0 weight % cobalt, 2.0 weight % chromium, 2.0 weight % molybdenum, 2.0 weight vanadium and the remainder iron was manufactured as Example 7. After annealing in hydrogen for 10 hrs. at 850 degrees Celsius a coercivity field strength of $H_c$=2.51 A/cm, an induction of $B_{160}$=2.02 T given a modulation of 160 A/cm, as well as a remanence $B_R$=0.82 T were measured. The specific electrical resistance amounted to 0.61 $\Omega mm^2/m$.

Significantly faster switching times in magnetic circuits can be achieved with the alloys manufactured in accordance with the principles of the present invention set forth in the above table, both during magnetization and during demagnetization. When alloys of the type set forth in the table above are employed in exciting circuits, these circuits can be switched at significantly higher frequencies of the excitation current than was heretofore possible.

Although modifications and changes may be suggested by those skilled in the art, it is the intention of the inventors to embody within the patent warranted hereon all changes and modifications as reasonably and properly come within the scope of their contribution to the art.

We claim as our invention:

1. A core for use in an excitation circuit having means for generating a rapidly changing magnetic field, said core interacting with said magnetic field and comprising:

a soft magnetic alloy having a coercive field strength lower than or equal to 3.2 A/cm and a saturation flux density greater than 1.9 Tesla, said magnetic alloy consisting of cobalt in a range of 6 through 30 weight percent, at least one element selected from the group consisting of chromium, molybdenum, vanadium, and tungsten in a range of 3 through 8 weight percent, and the remainder consisting of iron.

2. A core as claimed in claim 1 having cobalt in a range from 10 through 20 weight percent.

3. A core as claimed in claim 1 having said at least one element selected from the group consisting of chromium, molybdenum, vanadium and tungsten in a range of 4 through 8 weight percent.

4. A core as claimed in claim 1 having said at least one element selected from the group consisting of chromium, molybdenum, vanadium and tungsten in a range from 5 through 8 weight percent and having an electrical resistivity greater than 0.5 $\mu\Omega\cdot m$ and an induction of greater than 1.9 Tesla given a field strength of 160 A/cm.

* * * * *